US011826872B2

(12) United States Patent
Wu et al.

(10) Patent No.: US 11,826,872 B2
(45) Date of Patent: Nov. 28, 2023

(54) TEMPERATURE AND SLURRY FLOW RATE CONTROL IN CMP

(71) Applicant: Applied Materials, Inc., Santa Clara, CA (US)

(72) Inventors: Haosheng Wu, San Jose, CA (US); Jianshe Tang, San Jose, CA (US); Brian J. Brown, Palo Alto, CA (US); Shih-Haur Shen, Sunnyvale, CA (US); Shou-Sung Chang, Mountain View, CA (US); Hari Soundararajan, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 128 days.

(21) Appl. No.: 17/357,802

(22) Filed: Jun. 24, 2021

(65) Prior Publication Data

US 2021/0402553 A1 Dec. 30, 2021

Related U.S. Application Data

(60) Provisional application No. 63/045,684, filed on Jun. 29, 2020.

(51) Int. Cl.
*B24B 37/015* (2012.01)
*B24B 57/02* (2006.01)

(52) U.S. Cl.
CPC ..... *B24B 37/015* (2013.01); *B24B 57/02* (2013.01)

(58) Field of Classification Search
CPC ..... B24B 37/015; B24B 57/02
(Continued)

(56) References Cited

U.S. PATENT DOCUMENTS 4,450,652 A 5/1984 Walsh
4,919,232 A 4/1990 Lofton
(Continued)

FOREIGN PATENT DOCUMENTS

CN 101500721 8/2009
CN 102179757 9/2011
(Continued)

OTHER PUBLICATIONS

Banerjee et al., "Post CMP Aqueous and CO2 Cryogenic Cleaning Technologies for Low k and Copper Integration," CMPUG Symposium, Poster Abstract, Jan. 2015, 2 pages.
(Continued)

*Primary Examiner* — Joel D Crandall
*Assistant Examiner* — Shantese L McDonald
(74) *Attorney, Agent, or Firm* — Fish & Richardson P.C.

(57) ABSTRACT

A chemical mechanical polishing system includes a polishing a port to dispense polishing liquid onto a polishing pad and a liquid flow controller to control a flow rate of the polishing liquid to the port, a temperature control system to control a temperature of the polishing pad, and a control system. The control system is configured to obtain a baseline removal rate, a baseline temperature and a baseline polishing liquid flow rate. A function is stored relating removal rate to polishing liquid flow rate and temperature. The function is used to determine a reduced polishing liquid flow rate and an adjusted temperature such that a resulting removal rate is not below the baseline removal rate. The liquid flow controller is controlled to dispense the polishing liquid at the reduced polishing liquid flow rate and control the temperature control system so that the polishing process reaches the adjusted temperature.

23 Claims, 3 Drawing Sheets

(58) Field of Classification Search
USPC ..... 451/5, 7, 41, 59
See application file for complete search history.

(56) References Cited

U.S. PATENT DOCUMENTS

| | | | |
|---|---|---|---|
| 5,088,242 | A | 2/1992 | Lubbering et al. |
| 5,196,353 | A | 3/1993 | Sandhu et al. |
| 5,478,435 | A | 12/1995 | Murphy et al. |
| 5,597,442 | A | 1/1997 | Chen et al. |
| 5,643,050 | A | 7/1997 | Chen |
| 5,709,593 | A | 1/1998 | Guthrie |
| 5,722,875 | A | 3/1998 | Iwashita et al. |
| 5,738,574 | A | 4/1998 | Tolles et al. |
| 5,762,544 | A | 6/1998 | Zuniga et al. |
| 5,765,394 | A | 6/1998 | Rhoades |
| 5,851,135 | A | 12/1998 | Sandhu et al. |
| 5,851,846 | A | 12/1998 | Matsui et al. |
| 5,868,003 | A | 2/1999 | Simas et al. |
| 5,873,769 | A | 2/1999 | Chiou et al. |
| 5,957,750 | A | 9/1999 | Brunelli |
| 6,000,997 | A | 12/1999 | Kao et al. |
| 6,012,967 | A | 1/2000 | Satake et al. |
| 6,023,941 | A | 2/2000 | Rhoades |
| 6,095,898 | A | 8/2000 | Hennofer et al. |
| 6,121,144 | A | 9/2000 | Marcyk et al. |
| 6,151,913 | A | 11/2000 | Lewis et al. |
| 6,159,073 | A | 12/2000 | Wiswesser et al. |
| 6,257,954 | B1 | 7/2001 | Ng et al. |
| 6,257,955 | B1 | 7/2001 | Springer et al. |
| 6,264,789 | B1 | 7/2001 | Pandey et al. |
| 6,280,289 | B1 | 8/2001 | Wiswesser et al. |
| 6,315,635 | B1 | 11/2001 | Lin |
| 6,399,501 | B2 | 6/2002 | Birang et al. |
| 6,422,927 | B1 | 7/2002 | Zuniga |
| 6,461,980 | B1 | 10/2002 | Cheung et al. |
| 6,494,765 | B2 | 12/2002 | Gitis et al. |
| 6,543,251 | B1 | 4/2003 | Gasteyer, III et al. |
| 6,640,151 | B1 | 10/2003 | Somekh et al. |
| 6,647,309 | B1 | 11/2003 | Bone |
| 6,776,692 | B1 | 8/2004 | Zuniga et al. |
| 6,829,559 | B2 | 12/2004 | Bultman et al. |
| 7,008,295 | B2 | 3/2006 | Wiswesser et al. |
| 7,016,750 | B2 | 3/2006 | Steinkirchner et al. |
| 7,196,782 | B2 | 3/2007 | Fielden et al. |
| 8,349,247 | B2 | 1/2013 | Ueno |
| 8,845,391 | B2 | 9/2014 | Sone et al. |
| 9,005,999 | B2 | 4/2015 | Xu et al. |
| 9,067,296 | B2 | 6/2015 | Ono et al. |
| 9,475,167 | B2 | 10/2016 | Maruyama et al. |
| 9,579,768 | B2 | 2/2017 | Motoshima et al. |
| 9,630,295 | B2 | 4/2017 | Peng et al. |
| 9,782,870 | B2 | 10/2017 | Maruyama et al. |
| 10,035,238 | B2 | 7/2018 | Maruyama et al. |
| 2001/0055940 | A1 | 12/2001 | Swanson |
| 2002/0039874 | A1 | 4/2002 | Hecker et al. |
| 2002/0058469 | A1 | 5/2002 | Pinheiro et al. |
| 2002/0065002 | A1 | 5/2002 | Handa et al. |
| 2003/0055526 | A1 | 3/2003 | Avanzino et al. |
| 2003/0211816 | A1 | 11/2003 | Liu et al. |
| 2004/0097176 | A1 | 5/2004 | Cron |
| 2005/0024047 | A1 | 2/2005 | Miller et al. |
| 2005/0042877 | A1 | 2/2005 | Salfelder et al. |
| 2005/0048882 | A1 | 3/2005 | Kiuchi et al. |
| 2005/0211377 | A1 | 9/2005 | Chen et al. |
| 2007/0035020 | A1 | 2/2007 | Umemoto |
| 2007/0238395 | A1 | 10/2007 | Kimura et al. |
| 2009/0258573 | A1 | 10/2009 | Muldowney et al. |
| 2010/0047424 | A1 | 2/2010 | Cousin et al. |
| 2010/0081360 | A1 | 4/2010 | Xu et al. |
| 2010/0227435 | A1 | 9/2010 | Park et al. |
| 2010/0279435 | A1 | 11/2010 | Xu et al. |
| 2011/0159782 | A1 | 6/2011 | Sone et al. |
| 2012/0034846 | A1 | 2/2012 | Minamihaba et al. |
| 2012/0040592 | A1 | 2/2012 | Chen et al. |
| 2012/0190273 | A1 | 7/2012 | Ono et al. |
| 2012/0276816 | A1* | 11/2012 | Ono ..... B24B 37/105 451/7 |
| 2013/0023186 | A1 | 1/2013 | Motoshima et al. |
| 2013/0045596 | A1 | 2/2013 | Eda et al. |
| 2014/0004626 | A1* | 1/2014 | Xu ..... B24B 37/015 257/E21.528 |
| 2014/0024297 | A1 | 1/2014 | Cahndraeskaran et al. |
| 2014/0187122 | A1 | 7/2014 | Ishibashi |
| 2015/0024661 | A1 | 1/2015 | Peng et al. |
| 2015/0196988 | A1 | 7/2015 | Watanabe |
| 2015/0224621 | A1 | 8/2015 | Motoshima et al. |
| 2015/0224623 | A1 | 8/2015 | Xu et al. |
| 2017/0232572 | A1 | 8/2017 | Brown |
| 2017/0239778 | A1* | 8/2017 | Maruyama ..... B24B 37/20 |
| 2017/0355059 | A1* | 12/2017 | Benner ..... H01L 21/6708 |
| 2018/0236631 | A1 | 8/2018 | Eto et al. |
| 2019/0126428 | A1 | 5/2019 | Martuyama et al. |
| 2019/0143476 | A1 | 5/2019 | Wu |
| 2020/0001425 | A1 | 1/2020 | Huang |
| 2020/0001426 | A1 | 1/2020 | Soundararajan et al. |
| 2020/0001427 | A1 | 1/2020 | Soundararajan et al. |
| 2020/0262024 | A1 | 8/2020 | Chang et al. |
| 2021/0046602 | A1 | 2/2021 | Wu et al. |
| 2021/0046603 | A1 | 2/2021 | Wu et al. |
| 2021/0046604 | A1 | 2/2021 | Wu et al. |

FOREIGN PATENT DOCUMENTS

| | | |
|---|---|---|
| CN | 207171777 | 4/2018 |
| JP | H11-033897 | 2/1999 |
| JP | 2000-015561 | 1/2000 |
| JP | 2003-197586 | 7/2003 |
| JP | 2004-202666 | 7/2004 |
| JP | 2004-306173 | 11/2004 |
| JP | 2005-311246 | 11/2005 |
| JP | 2007-035973 | 2/2007 |
| JP | 2013-042066 | 2/2013 |
| JP | 2014-188596 | 10/2014 |
| JP | 2015-131361 | 7/2015 |
| JP | 2018-030181 | 3/2018 |
| KR | 10-2006-0076332 | 7/2006 |
| KR | 10-2009-0046468 | 5/2009 |
| KR | 10-2012-0084671 | 7/2012 |
| KR | 10-2016-0145305 | 12/2016 |
| KR | 10-1816694 | 1/2018 |
| KR | 10-2020-0056015 | 5/2020 |
| TW | 201101385 | 1/2011 |
| TW | 201304908 | 1/2013 |
| TW | 202000368 | 1/2020 |
| WO | WO 1990/13735 | 11/1990 |
| WO | WO 2000/58054 | 10/2000 |
| WO | WO 2002/17411 | 2/2002 |
| WO | WO 2014/113220 | 7/2014 |

OTHER PUBLICATIONS

International Search Report and Written Opinion in International Appln. No. PCT/US2021/039007, dated Oct. 18, 2021, 10 pages.
Sampumo et al., "Pad Surface Thermal Management during Copper Chemical Mechanical Planarization," Presented Oct. 1, 2015 at lie International Conference on Planarization/CMP Technology, 2015, Sep. 30-Oct. 2, 2015, Session D-4, Chandler, AZ, USA, 24 pages.
Wu et al., "Pad Surface Thermal Management during Copper Chemical: Mechanical Planarization," ECS Journal of Solid State Science and Technology, Apr. 2015, 4(7):P206-12.
Office Action in Taiwanese Appln. No. 110123523, dated Aug. 5, 2022, 14 pages (with English search report).
Office Action in Indian Appln. No. 202347003540, dated Apr. 6, 2023, 5 pages (with English translation).

* cited by examiner

TEMPERATURE AND SLURRY FLOW RATE CONTROL IN CMP

CROSS-REFERENCE TO RELATED APPLICATIONS

This application claims priority to U.S. Application Ser. No. 63/045,684, filed on Jun. 29, 2020, the disclosure of which is incorporated by reference.

TECHNICAL FIELD

The present disclosure relates to combined control of the temperature of a polishing pad and the flow rate of the polishing liquid, e.g., slurry, in chemical mechanical polishing (CMP).

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and polishing the filler layer until the top surface of a patterned layer is exposed or a layer of desired thickness remains over. Planarization can also be used to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, typically a slurry with abrasive particles, supplied to the surface of the polishing pad.

The removal rate in the polishing process can be sensitive to temperature. Various techniques to control temperature during polishing have been proposed.

SUMMARY

In one aspect, a chemical mechanical polishing system includes a platen to support a polishing pad, a carrier head to hold a substrate in contact with the polishing pad, a motor to generate relative motion between the platen and the carrier head, a polishing liquid delivery system including a port to dispense polishing liquid onto the polishing pad and a liquid flow controller in a flow line between the port and a polishing liquid supply to control a flow rate of the polishing liquid to the port, a temperature control system to control a temperature of the polishing pad, and a control system coupled to the liquid flow controller and the valve. The control system is configured to obtain a baseline removal rate value, obtain a baseline temperature value and a baseline polishing liquid flow rate value, store a function relating removal rate to polishing liquid flow rate and temperature, determine using the function a reduced polishing liquid flow rate value and an adjusted temperature value such that a resulting removal rate value is equal to or greater than the baseline removal rate value, and control the liquid flow controller to dispense the polishing liquid at the reduced polishing liquid flow rate value and control the temperature control system so that a polishing process temperature reaches the adjusted temperature value.

Implementations may include one or more of the following.

The temperature control system may be a heating system, e.g., one or more of a resistive heater in the platen, a heat lamp positioned to direct heat onto the polishing pad, or a dispenser to deliver a heated fluid other than the polishing liquid onto the polishing pad. The temperature control system may be a cooling system, e.g., one or more of coolant channels extending through the platen, a thermoelectric cooler on the platen, or a dispenser to deliver a coolant fluid other than the polishing liquid onto the polishing pad.

Possible advantages may include, but are not limited to, one or more of the following.

The flow rate of polishing liquid, e.g., slurry, to the polishing pad can be reduced while maintaining the removal rate. Less polishing liquid is used, thus reducing the cost of consumables and overall cost of operation.

The details of one or more implementations are set forth in the accompanying drawings and the description below. Other aspects, features, and advantages will be apparent from the description and drawings, and from the claims.

DETAILED DESCRIPTION

The total cost of ownership of a chemical mechanical polishing system depends on both the initial capital costs for the polishing tool and the cost of consumable, e.g., polishing liquid, used in the polishing process. In particular, the polishing liquid, e.g., abrasive slurry, used in CMP can be a particularly large contributor to the overall costs. However, the flow rate of the polishing liquid cannot simply be arbitrarily decreased, as this can reduce the removal rate and thus decrease throughput. For example, in some metal polishing processes, reducing the slurry flow rate by 30% will result in a drop in the removal rate of 10%, and thus about a 10% drop in throughput.

Chemical mechanical polishing operates by a combination of mechanical abrasion and chemical etching at the interface between the substrate, polishing liquid, and polishing pad. As chemical-mechanical polishing is partially dependent on chemical reactions, the polishing process is a temperature-dependent process. Thus, the removal rate of most thin film materials in a CMP process is related to process temperature.

A technique that can be used to reduce the consumption of polishing liquid while maintaining a desired throughput is to modify the temperature of the polishing process so as to offset or compensate for the reduction in removal rate due to the reduction of in polishing liquid flow rate.

Figure 1A:
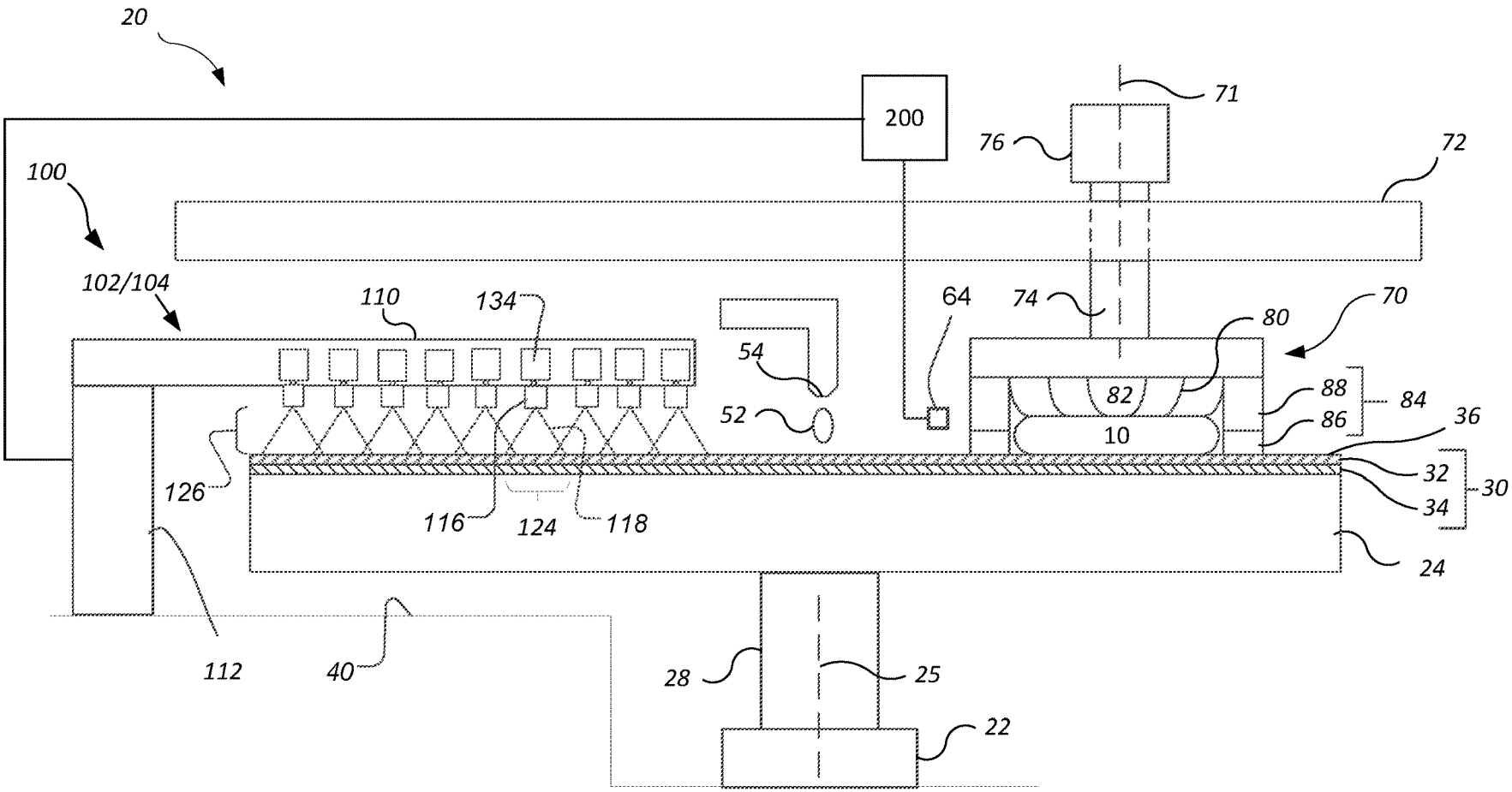
FIG. 1A is a schematic cross-sectional view of an example of a polishing station of the polishing apparatus.
Figure 1B:
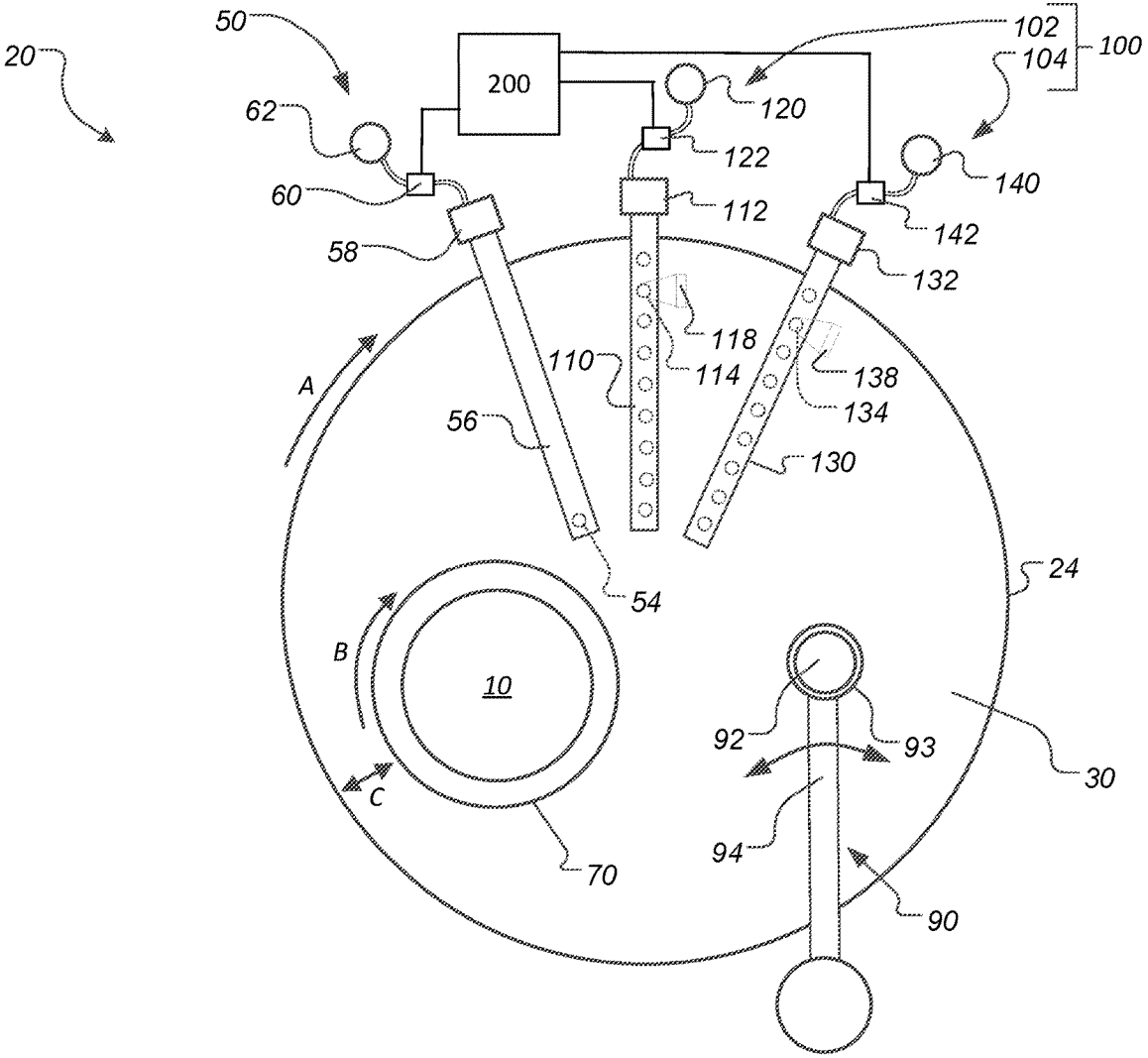
FIG. 1B is a schematic top view of an example polishing station of the chemical mechanical polishing apparatus.

FIGS. 1A and 1B illustrate an example of a polishing station 20 of a chemical mechanical polishing system. The polishing station 20 includes a rotatable disk-shaped platen 24 on which a polishing pad 30 is situated. The platen 24 is operable to rotate (see arrow A in FIG. 1B) about an axis 25. For example, a motor 22 can turn a drive shaft 28 to rotate the platen 24. The polishing pad 30 can be a two-layer polishing pad with an outer polishing layer 34 and a softer backing layer 32.

The polishing station 20 can include a polishing liquid supply system 50 to dispense a polishing liquid 52, such as an abrasive slurry, through a port 54 onto the polishing pad 30. The polishing liquid supply system 50 can include arm 56 supported by a base 58 to extend over the platen 24. The port 54 can be at the end of the arm 56. The port 54 can be coupled through a liquid flow controller 60 to a polishing liquid supply 62, e.g., a reservoir or tank that holds the polishing liquid. The polishing liquid can be an abrasive slurry.

A carrier head 70 is operable to hold a substrate 10 against the polishing pad 30. The carrier head 70 is suspended from a support structure 72, e.g., a carousel or a track, and is connected by a drive shaft 74 to a carrier head rotation motor 76 so that the carrier head can rotate about an axis 71. Optionally, the carrier head 70 can oscillate laterally, e.g., on sliders on the carousel, by movement along the track, or by rotational oscillation of the carousel itself.

The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. The carrier head 70 can include a retaining ring 84 to hold the substrate.

In operation, the platen is rotated about its central axis 25, and the carrier head is rotated about its central axis 71 (see arrow B in FIG. 1B) and translated laterally (see arrow C in FIG. 1B) across the top surface of the polishing pad 30.

The polishing station 20 can also include a pad conditioner 90 with a conditioner disk 92 held by a conditioner head 93 at the end of a conditioner arm 94. The conditioner disk 92 can be used to maintain the surface roughness of the polishing pad 30.

In some implementations, the polishing station 20 includes a temperature sensor 64 to monitor a temperature in the polishing station or a component of/in the polishing station, e.g., the temperature of the polishing pad 30 and/or slurry 38 on the polishing pad. For example, the temperature sensor 64 could be an infrared (IR) sensor, e.g., an IR camera, positioned above the polishing pad 30 and configured to measure the temperature of the polishing pad 30 and/or slurry 38 on the polishing pad. In particular, the temperature sensor 64 can be configured to measure the temperature at multiple points along the radius of the polishing pad 30 in order to generate a radial temperature profile. For example, the IR camera can have a field of view that spans the radius of the polishing pad 30.

In some implementations, the temperature sensor is a contact sensor rather than a non-contact sensor. For example, the temperature sensor 64 can be thermocouple or IR thermometer positioned on or in the platen 24. In addition, the temperature sensor 64 can be in direct contact with the polishing pad.

In some implementations, multiple temperature sensors could be spaced at different radial positions across the polishing pad 30 in order to provide the temperature at multiple points along the radius of the polishing pad 30. This technique could be use in the alternative or in addition to an IR camera.

Although illustrated in FIG. 1A as positioned to monitor the temperature of the polishing pad 30 and/or slurry 38 on the pad 30, the temperature sensor 64 could be positioned inside the carrier head 70 to measure the temperature of the substrate 10. The temperature sensor 64 can be in direct contact (i.e., a contacting sensor) with the semiconductor wafer of the substrate 10. In some implementations, multiple temperature sensors are included in the polishing station 22, e.g., to measure temperatures of different components of/in the polishing station.

The polishing system 20 also includes a temperature control system 100 to control the temperature of the polishing pad 30 and/or slurry 38 on the polishing pad. The temperature control system 100 that operates by delivering a temperature-controlled medium onto the polishing surface 36 of the polishing pad 30 (or onto a polishing liquid that is already present on the polishing pad). The temperature control system can a heating system 102 and/or a cooling system 104 The heating system 102 operates by delivering a hot fluid, e.g., hot water or steam. The cooling system 102 operates by delivering a coolant, e.g., cold water or air.

The medium can be delivered by flowing through apertures, e.g., holes or slots, e.g., provided by one or more nozzles, on a delivery arm. The apertures can be provided by a manifold that is connected to a source of the heating medium.

An example heating system 102 includes an arm 110 that extends over the platen 24 and polishing pad 30 from an edge of the polishing pad to or at least near (e.g., within 5% of the total radius of the polishing pad) the center of polishing pad 30. The arm 110 can be supported by a base 112, and the base 112 can be supported on the same frame 40 as the platen 24. The base 112 can include one or more an actuators, e.g., a linear actuator to raise or lower the arm 110, and/or a rotational actuator to swing the arm 110 laterally over the platen 24. The arm 110 is positioned to avoid colliding with other hardware components such as the polishing head 70, pad conditioning disk 92, the polishing liquid dispensing arm 56, and coolant delivery arm 130.

Multiple openings 114 are formed in the bottom surface of the arm 110. Each opening 114 is configured to direct a heating fluid, e.g., gas or vapor, e.g., steam, onto the polishing pad 30. The openings can be nozzles 116 that direct the heating fluid in a spray 118 onto the polishing pad 30.

The various openings 114 can direct heating fluid onto different radial zones on the polishing pad 30. Adjacent radial zones can overlap. Optionally, some of the openings 1144 can be oriented so that a central axis of the spray from that opening is at an oblique angle relative to the polishing surface 36. The heating fluid can be directed from one or more of the openings 141 to have a horizontal component in a direction opposite to the direction of motion of polishing pad 30 in the region of impingement as caused by rotation of the platen 24.

Although FIG. 1B illustrates the openings 114 as spaced at even intervals, this is not required. The nozzles 116 could be distributed non-uniformly either radially, or angularly, or both. For example, openings 114 could be clustered more densely toward the center of the polishing pad 30. As another example, openings 114 could be clustered more densely at a radius corresponding to a radius at which the polishing liquid 39 is delivered to the polishing pad 30 by the slurry delivery arm 39. In addition, although FIG. 1B illustrates nine openings, there could be a larger or smaller number of openings.

The arm 110 can be supported by the base 112 so that the openings 114 are separated from the polishing pad 30 by a gap. The gap can be 0.5 to 5 mm. In particular, the gap can be selected such that the heat of the heating fluid does not significantly dissipate before the fluid reaches the polishing pad. For example, the gap can be selected such that steam emitted from the openings does not condense before reaching the polishing pad.

The heating system 104 can include a source 120 of hot fluid, and the source 120 can be connected to the arm 110 by a fluid passage that flows through a controllable valve 122. The source 120 can be a steam generator, e.g., a vessel in which water is boiled to generate steam gas. The passage can be provide by one or more of tubing, piping or channels through a solid body.

The heating fluid can be mixed with another gas, e.g., air, or a liquid, e.g., heated water, or the heating fluid can be substantially pure steam. In some implementations, other chemicals are added to the heating fluid.

Assuming steam is used, the temperature of the steam can be 90 to 200° C. when the steam is generated (e.g., in the fluid source 120). The temperature of the steam can be between 90 to 150° C. when the steam is dispensed through the openings 116, e.g., due to heat loss in transit. In some implementations, steam is delivered by the openings 116 at a temperature of 70-100° C., e.g., 80-90° C. In some implementations, the steam delivered by the nozzles is superheated, i.e., is at a temperature above the boiling point.

The polishing system 20 can also include a cooling system 104. The cooling system 104 can be constructed similarly to the heating system 102 as described above, with an arm 130 supported by a base 132 and having apertures 134, a source 140, and a fluid passage that connects the source 140 to the arm through a controllable valve 142. However, the source 140 is a source of a coolant fluid, and the cooling system 104 dispenses the coolant fluid onto the polishing pad 30, e.g., in a spray 138.

The coolant fluid can be a liquid, e.g, water at or below 20° C., a gas at or below 20° C., or a mixture of liquid and gas. For example, the coolant fluid can be air with aerosolized water droplets. The opening can be provided by a nozzle, and the nozzle can be a convergent-divergent nozzle so that the coolant fluid is further cooled by flowing through the nozzle. In some implementations, the liquid component is solidified by the temperature drop through the nozzle, e.g., the coolant fluid can include ice crystals when sprayed onto the polishing pad.

The polishing system can also include a high pressure rinsing system, e.g., an arm with nozzles to spray a rinsing liquid onto the polishing pad, and a wiper blade or body to evenly distribute the polishing liquid 38 across the polishing pad 30.

The polishing system 20 also includes a controller 200 to control operation of various components, e.g., polishing liquid delivery system 50 and the temperature control system 100. The controller 200 can be configured to receive the temperature measurements from the temperature sensor 64. The controller 200 can compare the measured temperature to a target temperature, and control the valves 122 and/or 142 to control the flow rate of the heating fluid and/or coolant onto the polishing pad 30 to achieve the target temperature.

The desired temperature and the flow rate of the polishing liquid can be set in conjunction to achieve a desired removal rate while reducing the consumption of polishing liquid.

In order to determine the appropriate temperature, data relating the removal rate to polishing liquid flow rates and temperatures is obtained. For example, one or more test substrates can polished at a variety of polishing liquid flow rates and temperatures, and the removal rate at each pair of conditions (holding other polishing parameters constant) is measured. This data can be stored in a lookup table (LUT) with removal rate as a function of both flow rate (e.g., as the column) and temperature (e.g., as the row).

Figure 2:
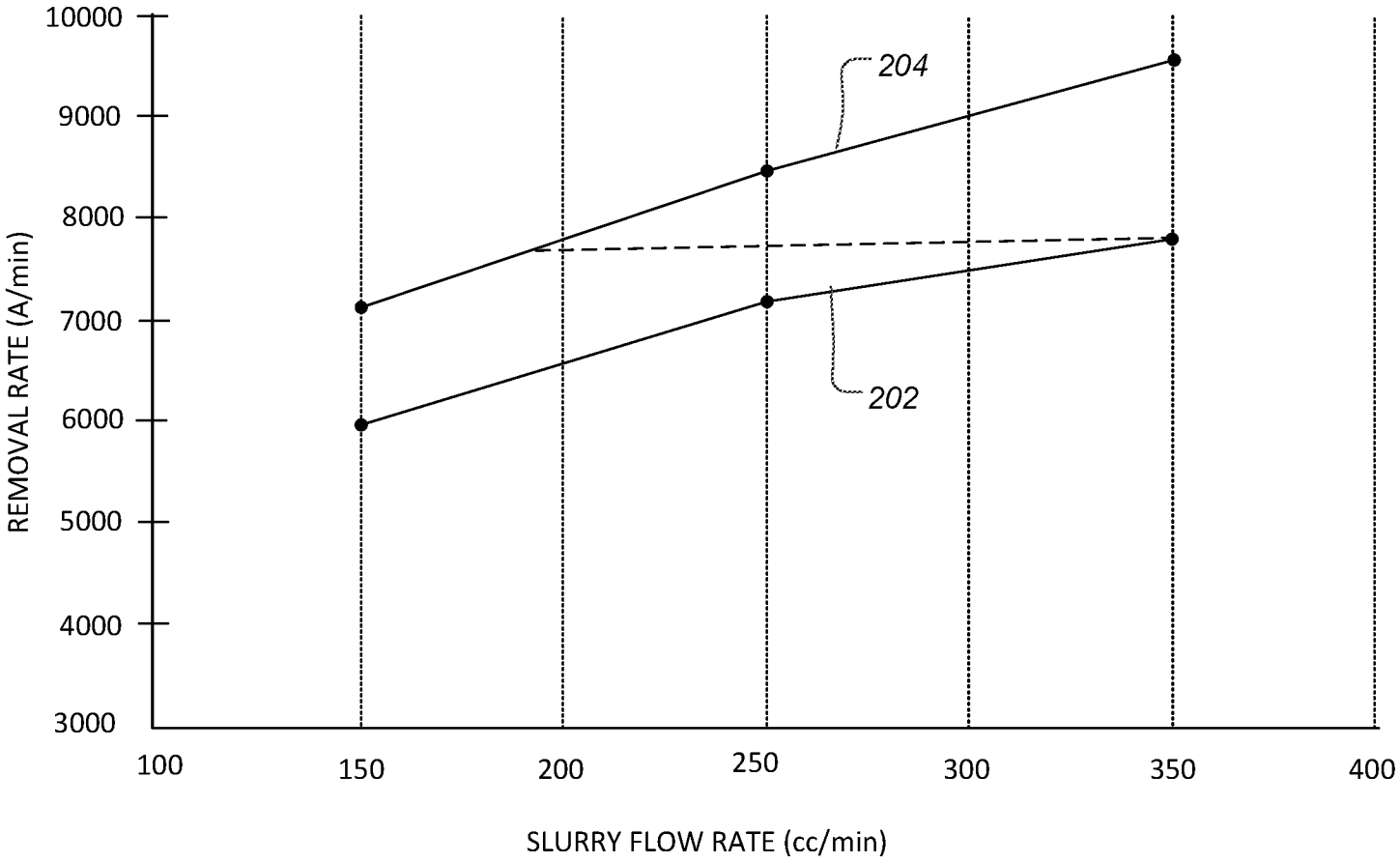
FIG. 2 illustrates experimental results showing removal rate as a function of low rate and temperature.

FIG. 2 illustrates experimental results from polishing of test substrates. Points connected by graph line 202 show measured removal rates at several slurry flow rates during polishing of a metal layer on a test substrate when the temperature is unregulated by a temperature control system, and reached a temperature (due to heat generated by friction) of about 40-50° C. Points connected by graph line 204 show measured removal rates at different slurry flow rates during polishing of the metal layer on a test substrate when the temperature is was regulated by a temperature control system to be about 65° C. As an example, at a flow rate of 250cc/min, regulating and increasing the temperature to 65° C. increased the removal rate from about 7200 Å/min to about 8500 Å/min.

As shown by broken line 208, if a polishing process had been run at about 45° C. and a flow rate of 350 cc/min, increasing the temperature of the polishing process to 65° C. permits the flow rate to be reduced to 200 cc/min while maintaining the same removal rate, i.e., a reduction of about 43% consumption of the slurry.

Although FIG. 2 illustrates only two temperatures and three flow rates, a larger number of temperatures and/or flow rates can be tested to provide the data relating the removal rate to flow rate and temperature. This data is converted to or provides a function with removal rate as a function of two variables, i.e., temperature and flow rate. For example, the data can be maintained in a LUT in the controller, and given two of three values (e.g., the temperature and flow rate, or temperature and removal rate, or flow rate and removal rate), the controller can perform linear interpolation between the closest data points to calculate the third value. Alternatively, a function, e.g., a multivariable polynomial, can be fit to the data.

In general, because the rate of chemical reactions increases with temperature, in many polishing operations the removal rate will increase with temperature. For example, in a typical metal polishing process, the removal rate increases with temperature. Thus, the function stored in the controller can include a range over which the removal rate increases, e.g., increases monotonically, as temperature increases. Thus, the techniques described below that utilize a removal rate that increase with temperature can be used with polishing of a metal layer, e.g., copper, tungsten, cobalt, etc. On the other hand, there are some polishing process, e.g., polishing of some oxide materials, in which the removal rate decreases with temperature. In this case, the function stored in the controller can include a range over which the removal rate decreases, e.g., decreases monotonically, as temperature increases. Thus, the techniques described below that utilize a removal rate that decreases with temperature can be used with polishing of an oxide layer, e.g., silicon oxide.

Returning to FIGS. 1A and 1B, the control system 200 can store or receive a polishing recipe, which includes data representing one or more of a baseline removal rate, baseline temperature, baseline polishing liquid flow rate, and baseline polishing time. In a normal operating mode, a control algorithm can set machine control parameters so that the polishing system operates at the baseline temperature and baseline flow rate over the entire polishing operation. For example, the control system 200 can use feedback from the temperature sensor to control the valve 122 or 142 to control the dispensing rate of heating or cooling fluid onto the polishing pad so as to achieve the baseline temperature. Similarly, the control system 200 can control the liquid flow controller 60 so as to dispense the polishing liquid at the baseline flow rate. If necessary, the control system 200 can modify other machine parameters, e.g., the pressure applied by the carrier head, in order to achieve the baseline polishing rate and/or the baseline polishing time.

However, the control system 200 can also be configure to select at least a portion of the polishing operation during which the polishing liquid flow rate will be reduced from the baseline flow rate, but the temperature will be modified to so that the resulting removal rate remains equal to or increases relative to the baseline removal rate. In some implementations, the portion of the polishing operation substantially corresponds to a bulk polishing operation, i.e., before exposure of an underlying layer. In some implementations, the selected portion begins at a set point (either a set time or a set percentage of the total expected polishing time) after the start of polishing. Alternatively, the selected portion can begin when the polishing operation begins. In some implementations, the selected portion ends at a set point (either a set time or a set percentage of the total expected polishing time) before the expected polishing endpoint. Determining the expected endpoint can take into account the adjusted polishing rate and polishing time discussed below. Alternatively, the selected portion can extend to the end of the operation, e.g., as determined by time or by an endpoint detection based on an in-situ monitoring system.

In order to determine the modified temperature and flow rate, the control system 200 can select a modified temperature $T_{CONTROL}$. In particular, using the multi-variable function described above, the controller 200 can find a modified temperature $T_{MOD}$ that, at the current baseline flow rate $FR_0$, increases the removal rate from the baseline removal rate $RR_0$ to a modified removal rate $RR_{T\text{-}MOD}$. For example, the controller can attempt to maximize the removal rate for the baseline flow rate $FR_0$. This can be subject to various constraints, e.g., operator safety or temperature range capacity of the temperature control system. The controller can calculate an increase in removal rate resulting from the modified temperature $T_{CONTROL}$. The removal rate increase can range from 1-100%.

The control system 200 can then calculate a maximum flow rate reduction such that a resulting reduction in removal rate is no more than the increase in removal rate resulting from the modified temperature. Using the multi-variable function described above, the control system can find a reduced polishing liquid flow rate $FR_{T\text{-}MOD}$ at which the resulting removal $RR_{T,FR\text{-}MOD}$ is equal to or greater than the baseline removal rate $RR_0$. The reduction in the polishing liquid flow rate can ranging from 1-99%, e.g., 15-60%.

To remove same target amount of the layer, the total baseline polish time can be adjusted, e.g., to $T_{MOD}=T_0*RR_0/RR_{T\text{-}MOD}$ (assuming that the temperature control is applied for the entire polishing operation).

The total slurry consumption ($SC_{MOD}$) in a temperature-controlled CMP process is $FR_{T\text{-}MOD}*T_{MOD}$, which is lower than the baseline slurry consumption $SC_0=FR_0*T_0$. The percentage of total slurry saving provided by a temperature-controlled CMP process is $SC_{MOD}/SC_0$.

In some cases, the removal rate of a temperature-controlled CMP process can be lower than baseline removal rate, provided that (i) total slurry consumption in the temperature-controlled process is still lower than baseline slurry consumption, and (ii) the throughput of the whole CMP tool is not negatively impacted.

As an alternative approach to determining the modified temperature and flow rate, the control system can determine a reduced polishing flow rate, calculate a reduction in removal rate resulting from the reduced polishing flow rate based on the second function, and calculate a minimum temperature change based on the first function to compensate for the reduction in removal rate.

The control system 200, and the functional operations thereof, can be implemented in digital electronic circuitry, in tangibly-embodied computer software or firmware, in computer hardware, or in combinations of one or more of them. The computer software can be implemented as one or more computer programs, i.e., one or more modules of computer program instructions encoded on a tangible non transitory storage medium for execution by, or to control the operation of, a processor of a data processing apparatus. The electronic circuitry and data processing apparatus can include a general purpose programmable computer, a programmable digital processor, and/or multiple digital processors or computers, as well as be special purpose logic circuitry, e.g., an FPGA (field programmable gate array) or an ASIC (application specific integrated circuit).

For the control system to be "configured to" perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

A number of embodiments have been described. Nevertheless, it will be understood that various modifications may be made. Accordingly, other embodiments are within the scope of the following claims.

What is claimed is:

1. A chemical mechanical polishing system, comprising:

a platen to support a polishing pad;

a carrier head to hold a substrate in contact with the polishing pad;

a motor to generate relative motion between the platen and the carrier head;

a polishing liquid delivery system including a port to dispense a polishing liquid onto the polishing pad and a liquid flow controller in a flow line between the port and a polishing liquid supply to control a flow rate of the polishing liquid to the port;

a temperature control system including an arm extending over the platen having at least one opening to deliver a heating or cooling fluid from a fluid source, other than the polishing liquid, onto the polishing pad and a valve in a fluid line between the at least one opening and the fluid source to controllably connect and disconnect the at least one opening and the fluid source; and a control system coupled to the liquid flow controller and the valve, the control system configured to obtain a baseline removal rate value, obtain a baseline temperature value and a baseline polishing liquid flow rate value, store a function relating removal rate to polishing liquid flow rate and temperature, determine, using the function, a reduced polishing liquid flow rate value and an adjusted temperature value such that a resulting removal rate value is equal to or greater than the baseline removal rate value, control the liquid flow controller to dispense the polishing liquid at the reduced polishing liquid flow rate value and control the valve to control flow of the heating or cooling fluid so that a polishing process temperature reaches the adjusted temperature value, determine a modified temperature, calculate, using the function and the modified temperature, an increase in removal rate from the baseline removal rate value based on the modified temperature, increase the baseline temperature to the modified temperature, and maximize the increase in removal rate for the baseline polishing liquid flow rate at the modified temperature.

2. The system of claim 1, comprising a temperature sensor positioned to measure a temperature of the polishing pad, and wherein the control system is configured to receive a temperature measurement and control a flow rate of the heating or cooling fluid to achieve the adjusted temperature value.

3. The system of claim 1, wherein the control system is configured to determine a reduced polishing flow rate, calculate a reduction in removal rate resulting from the reduced polishing flow rate based on the function, and calculate a minimum temperature change based on the function to compensate for the reduction in removal rate.

4. The system of claim 3, wherein the control system is configured to calculate the reduction in removal rate by calculating a percentage reduction in removal rate.

5. The system of claim 1, wherein the control system is further configured to, after maximizing the increase in removal rate for the baseline polishing liquid flow rate at the modified temperature, and calculate a maximum flow rate reduction based on the function such that a resulting reduction in removal rate is no more than the increase in removal rate resulting from the modified temperature.

6. The system of claim 5, wherein the control system is configured to calculate the increase in removal rate by calculating a percentage increase in removal rate.

7. The system of claim 1, wherein the function includes a temperature range over which removal rate increases monotonically with increasing temperature.

8. The system of claim 1, wherein the function includes a temperature range over which removal rate decreases monotonically with increasing temperature.

9. The system of claim 1, wherein the function includes values stored in a lookup table.

10. The system of claim 9, wherein the control system is configured to calculate a change to a removal rate by linear interpolation between the values in the lookup table.

11. The system of claim 1, wherein the temperature control system comprises a heating system configured to dispense the heating fluid onto the polishing pad.

12. The system of claim 11, wherein the heating fluid comprises steam.

13. The system of claim 1, wherein the temperature control system comprises a cooling system configured to dispense the cooling fluid onto the polishing pad.

14. A chemical mechanical polishing system, comprising:

a platen to support a polishing pad;

a carrier head to hold a substrate in contact with the polishing pad;

a motor to generate relative motion between the platen and the carrier head;

a polishing liquid delivery system including a port to dispense a polishing liquid onto the polishing pad and a liquid flow controller in a flow line between the port and a polishing liquid supply to control a flow rate of the polishing liquid to the port;

a temperature control system including an arm extending over the platen having at least one opening to deliver a heating or cooling fluid from a fluid source, other than the polishing liquid, onto the polishing pad and a valve in a fluid line between the at least one opening and the fluid source to controllably connect and disconnect the at least one opening and the fluid source, wherein the at least one opening comprises a nozzle configured to lower temperature of the heating or cooling fluid as the heating or cooling fluid passes through the nozzle; and a control system coupled to the liquid flow controller and the valve, the control system configured to obtain a baseline removal rate value, obtain a baseline temperature value and a baseline polishing liquid flow rate value, store a function relating removal rate to polishing liquid flow rate and temperature, determine, using the function, a reduced polishing liquid flow rate value and an adjusted temperature value such that a resulting removal rate value is equal to or greater than the baseline removal rate value, control the liquid flow controller to dispense the polishing liquid at the reduced polishing liquid flow rate value and control the valve to control flow of the heating or cooling fluid so that a polishing process temperature reaches the adjusted temperature value.

15. A chemical mechanical polishing system, comprising:

a platen to support a polishing pad;

a carrier head to hold a substrate in contact with the polishing pad;

a motor to generate relative motion between the platen and the carrier head;

a polishing liquid delivery system including a port to dispense a polishing liquid onto the polishing pad and a liquid flow controller in a flow line between the port and a polishing liquid supply to control a flow rate of the polishing liquid to the port;

a temperature control system to control a temperature of the polishing pad; and a control system coupled to the liquid flow controller, the control system configured to obtain a baseline removal rate value, obtain a baseline temperature value and a baseline polishing liquid flow rate value, store a function relating removal rate to polishing liquid flow rate and temperature, determine, using the function, a reduced polishing liquid flow rate value and an adjusted temperature value such that a resulting removal rate value is equal to or greater than the baseline removal rate value, control the liquid flow controller to dispense the polishing liquid at the reduced polishing liquid flow rate value and control the temperature control system so that a polishing process temperature reaches the adjusted temperature value, determine a modified temperature, calculate, using the function and the modified temperature, an increase in removal rate from the baseline removal rate based on the modified temperature, increase the baseline temperature to the modified temperature, and maximize the increase in removal rate for the baseline polishing liquid flow rate at the modified temperature.

16. The system of claim 15, wherein the temperature control system comprises a heating system.

17. The system of claim 16, wherein the heating system comprises one or more of a resistive heater in the platen, a heat lamp positioned to direct heat onto the polishing pad, or a dispenser to deliver a heated fluid other than the polishing liquid onto the polishing pad.

18. The system of claim 15, wherein the temperature control system comprises a cooling system.

19. The system of claim 18, wherein the cooling system comprises one or more of coolant channels extending through the platen, a thermoelectric cooler on the platen, or a dispenser to deliver a coolant fluid other than the polishing liquid onto the polishing pad.

20. The system of claim 15, comprising a temperature sensor positioned to measure a temperature of the polishing pad, and wherein the control system is configured to receive a temperature measurement and control the temperature control system to achieve the adjusted temperature value.

21. The system of claim 15, wherein the control system is configured to determine a reduced polishing flow rate, calculate a reduction in removal rate resulting from the reduced polishing flow rate based on the function, and calculate a minimum temperature change based on the function to compensate for the reduction in removal rate.

22. The system of claim 15, wherein the control system is configured to determine a modified temperature, calculate an increase in removal rate resulting from the modified temperature based on the function, and calculate a maximum flow rate reduction based on the function such that a resulting reduction in removal rate is no more than the increase in removal rate resulting from the modified temperature.

23. A computer program product, comprising a non-transitory computer-readable medium having instructions to cause one or more processors to:

obtain a baseline removal rate value for a polishing process;

obtain a baseline temperature value and a baseline polishing liquid flow rate value for the polishing process;

store a function relating removal rate to polishing liquid flow rate and temperature;

determine, using the function, a reduced polishing liquid flow rate value and an adjusted temperature value such that a resulting removal rate value is equal to or greater than the baseline removal rate value;

control a liquid flow controller to dispense a polishing liquid onto a polishing pad at the reduced polishing liquid flow rate value and control a temperature control system so that a polishing process temperature reaches the adjusted temperature value;

determine a modified temperature;

calculate, using the function and the modified temperature, an increase in removal rate from the baseline removal rate based on the modified temperature;

increase the baseline temperature to the modified temperature; and maximize the increase in removal rate for the baseline polishing liquid flow rate at the modified temperature.

* * * * *